US005454634A

United States Patent [19]

Herbst et al.

[11] Patent Number: 5,454,634

[45] Date of Patent: Oct. 3, 1995

[54] UNITARY INTERLOCKING FRAME FOR STORAGE CONTAINERS

[75] Inventors: John E. Herbst, Bolingbrook, Ill.; Richard H. Edwards, Doncaster, England

[73] Assignee: Fellowes Manufacturing Company, Itasca, Ill.

[21] Appl. No.: 100,056

[22] Filed: Jul. 30, 1993

[51] Int. Cl.[6] ..... A47B 87/00

[52] U.S. Cl. ..... 312/108; 312/111

[58] Field of Search ..... 312/107, 108, 312/111, 259; 108/27; 211/126, 194

[56] References Cited

U.S. PATENT DOCUMENTS

| | | | |
|---|---|---|---|
| 3,131,829 | 5/1964 | Masser | 312/107 |
| 3,429,632 | 2/1969 | Simon et al. . | |
| 3,552,579 | 1/1971 | Simon et al. . | |
| 3,707,023 | 12/1972 | Pfaffendorf et al. . | |
| 4,062,302 | 12/1977 | Krizan . | |
| 4,239,306 | 12/1980 | Klaus | 312/108 |
| 5,246,284 | 9/1993 | Merzon | 312/111 |

OTHER PUBLICATIONS

A Fellowes Mfg. Co. brochure entitled "Fellowes® Records Storage Systems," particularly pp. 2 and 5 which show a Super Stor/Drawer, (USA, 1993).

A Fellowes Mfg. Co. brochure entitled "Bankers Box® Records Storage Systems," particularly p. 10 which shows a Super Stor/Drawer, published in the United States and undated.

*Primary Examiner*—Kenneth J. Dorner
*Assistant Examiner*—George A. Anderson
*Attorney, Agent, or Firm*—Willian Brinks Hofer Gilson & Lione

[57] ABSTRACT

A unitary interlocking frame that surrounds the front of a shell of a storage container includes male interlocking members that interlock with female interlocking members provided on the frame of an adjacent container so that when the containers are vertically stacked they can be secured from relative movement with respect to each other.

31 Claims, 6 Drawing Sheets

FIG. 3
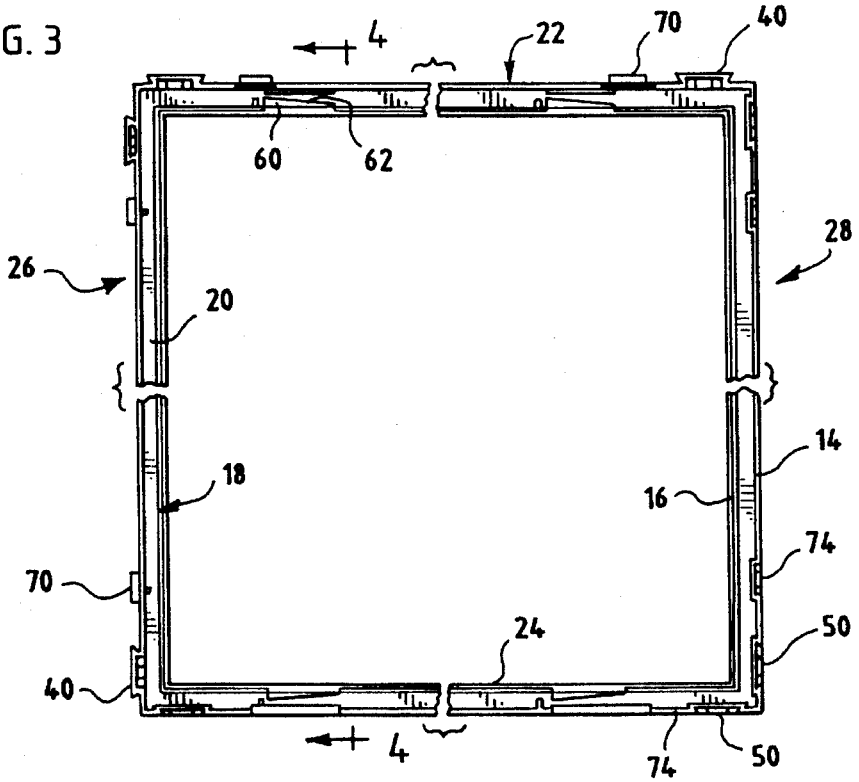
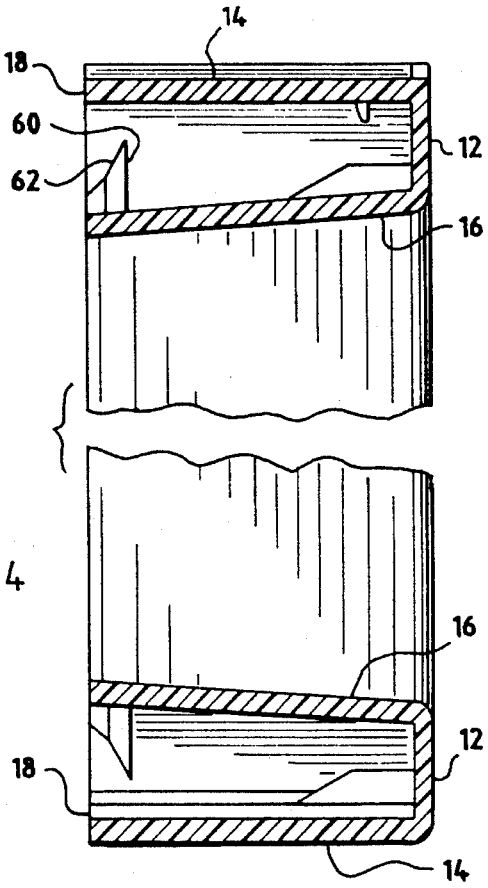
FIG. 4
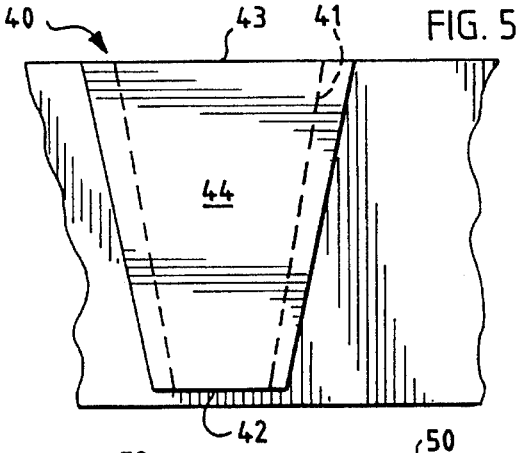
FIG. 5
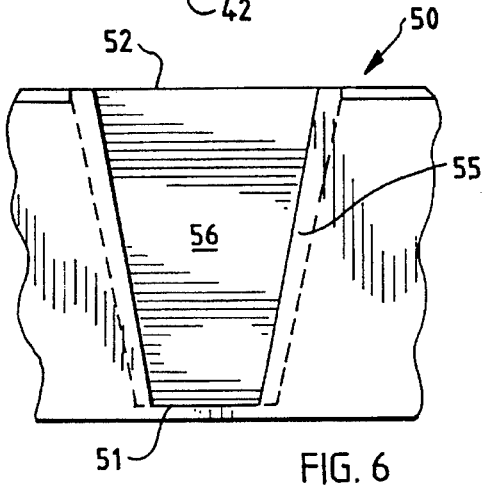
FIG. 6

FIG. 16
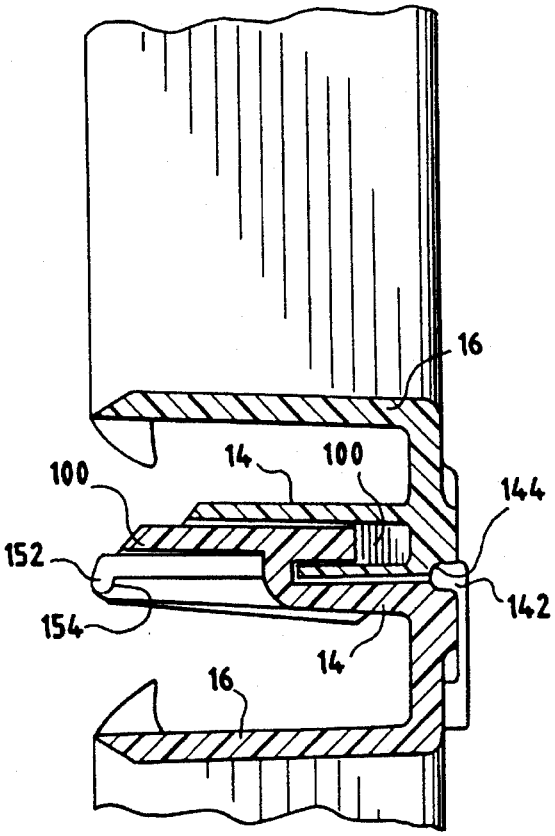
FIG. 17
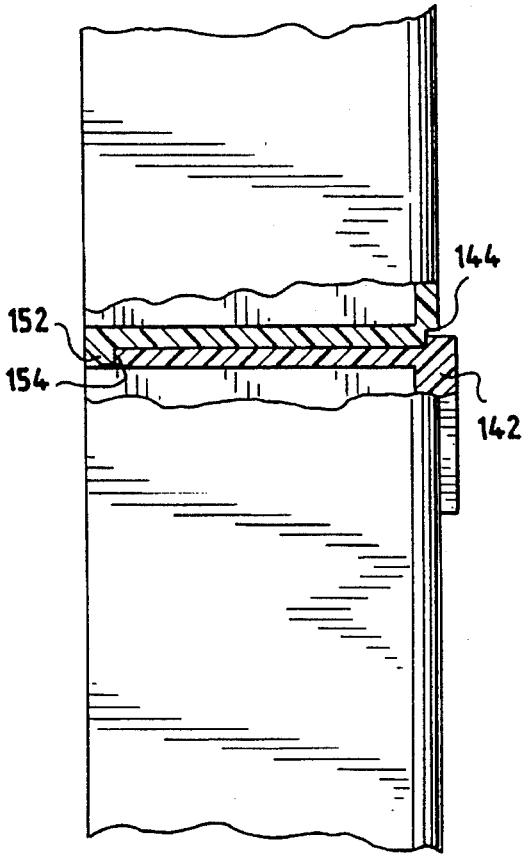
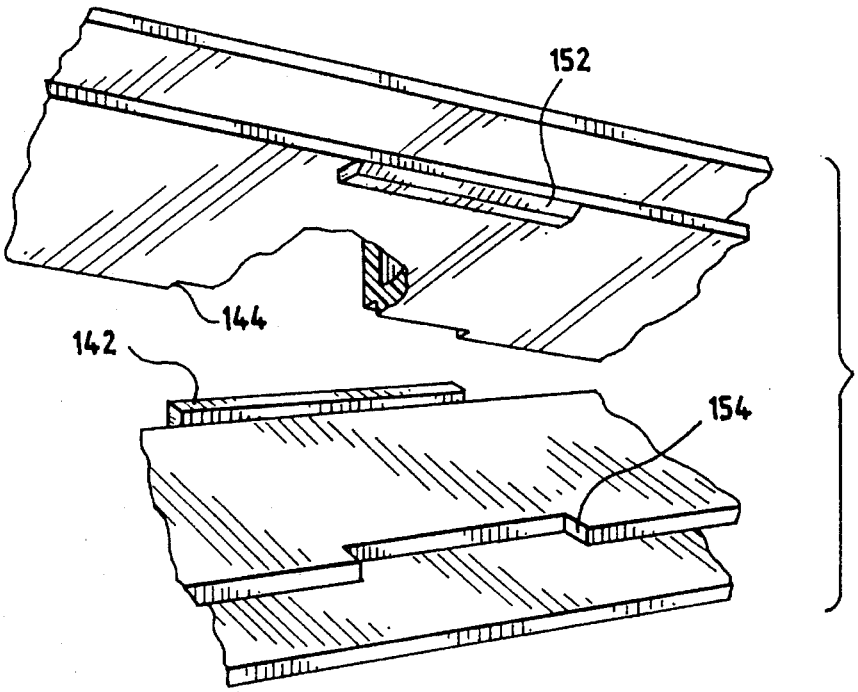
FIG. 18

UNITARY INTERLOCKING FRAME FOR STORAGE CONTAINERS

BACKGROUND OF THE INVENTION

The present invention relates to a unitary interlocking frame for use with a storage file container to allow a plurality of containers to be stacked and locked from relative movement.

File and storage containers of the lightweight, fiberboard type are widely used in homes and offices and generally include a fiberboard shell that receives a drawer that can be slidably removed from the shell to provide access to materials stored in the drawer. Frequently, the containers are stacked on top of each other to provide a multiple compartment storage assembly. One potential problem with vertically stacking the containers is that they may become dislodged or move relative to other vertically adjacent containers when the user attempts to open and close a drawer. Another problem with stacking such containers is that the drawers in the lower containers may be difficult to open due to bending of the shell near its front as a result of the weight from the vertically adjacent filled containers.

One solution to these problems has been to provide a device to interlock the containers together as a unitary assembly so that the containers can be vertically stacked. The devices used for this purpose have taken the form of metal strips or rims that are attached to the sidewalls of the containers and are provided with extensions for joining vertically adjacent containers together. Generally, at least one strip is provided near the front of the shell to minimize bending of the shell. In addition to being unsightly, stacking devices of this type may be unduly expensive in comparison with the low cost of the fiberboard containers with which they are used.

Another solution has been to provide a plastic frame that surrounds the front of the shell. To interlock the containers, interlocking clips are provided to lock vertically adjacent shells or frames as well as horizontally adjacent shells or frames so that the containers can be vertically stacked. The clips, however, increase the number of parts and thus cost of an interlocking system. In addition, the clips may become lost.

SUMMARY OF THE INVENTION

The present invention provides a unitary interlocking frame for use with file storage containers. The containers include a shell with an open front to slidably receive a drawer. The frame surrounds the perimeter of the open front of the shell of the storage container and includes at least one complementary integral male and female interlocking member. The male member is located on a side of the frame directly opposite the female member. The female interlocking members slidably receive the male interlocking members provided on an adjacent frame so that the frames and containers can be secured from relative movement with respect to each other. The frame is particularly useful for providing support to and interlocking the containers so that the containers can be vertically interlocked and stacked and the drawers can be easily removed.

Generally, the frame is in the shape of a parallelogram to define four sides. The frame comprises a front face having a rearward extending outer wall spaced from a rearward extending inner wall. The spaced apart walls define a channel that slidably receives the open front of the shell to surround its perimeter. At least one male interlocking member is integrally formed on the outer wall of at least one side of the frame and at least one female interlocking member is integrally formed on the outer wall of a side of the frame opposite the male interlocking member. As a result, the female interlocking member can slidably receive a male interlocking member of an adjacent identical frame to lock the frames from relative movement with respect to each other. Since the shell is received in the channel of the frame, the adjacent shells and containers are interlocked with respect to each other. To further secure adjacent frames, locking members are provided to restrict respective forward movement of adjacent frames.

Desirably, the frame is oriented on the shell so that at least one male interlock is provided on the top of the frame and at least one female interlock is provided on the bottom of the frame. It will be understood by one skilled in the art that vertically oriented containers will be interlocked. By providing the interlocking frame around the open perimeter of the shell, downward bending of the shell is reduced or obviated. Consequently, the drawers of the bottom containers will open as easily as the drawers of the top containers.

BRIEF DESCRIPTION OF THE DRAWINGS

FIG. 3 is a rear plan view of the interlocking frame of FIG. 2.

FIG. 4 is a cross sectional view along line 4—4 of FIG. 3 to show the retaining flanges.

FIG. 5 is a top view of one of the male interlocks used in the frame of FIG. 2.

FIG. 6 is a top view of one of the female interlocks used in the frame of FIG. 2.

FIG. 16 is a partial cross-sectional view of two frames and shows the male interlock engaging with the female interlock.

FIGS. 17 to a partial cross-sectional view of two vertically interlocked frames to show the locking members engaged.

FIG. 18 is a rear exploded view of a portion of two frames with a portion of the upper frame cut away to show the engagement of the locking members.

DETAILED DESCRIPTION OF THE INVENTION AND PREFERRED EMBODIMENTS

According to the present invention, a unitary interlocking frame is provided for use with storage containers so that a plurality of containers can be stacked and locked frown relative movement with respect to adjacent containers. The frame has a front face having a rearward extending outer wall spaced from a rearward extending inner wall to define a channel. At least one male interlocking member is integrally formed on the outer wall of at least one side of the frame. At least one female interlocking member is integrally formed on the outer wall of a side of the frame opposite the male interlocking member so that when two identical frames are positioned adjacent each other a male interlocking member can engage a female interlocking member to lock the frames from relative movement with respect to each other. Preferably, a locking member is also provided on the outer wall to restrict respective forward movement of adjacent frames. Such a frame is particularly useful with file storage containers that have a fiberboard shell with an open front to slidably receive a fiberboard drawer.

Figure 1:
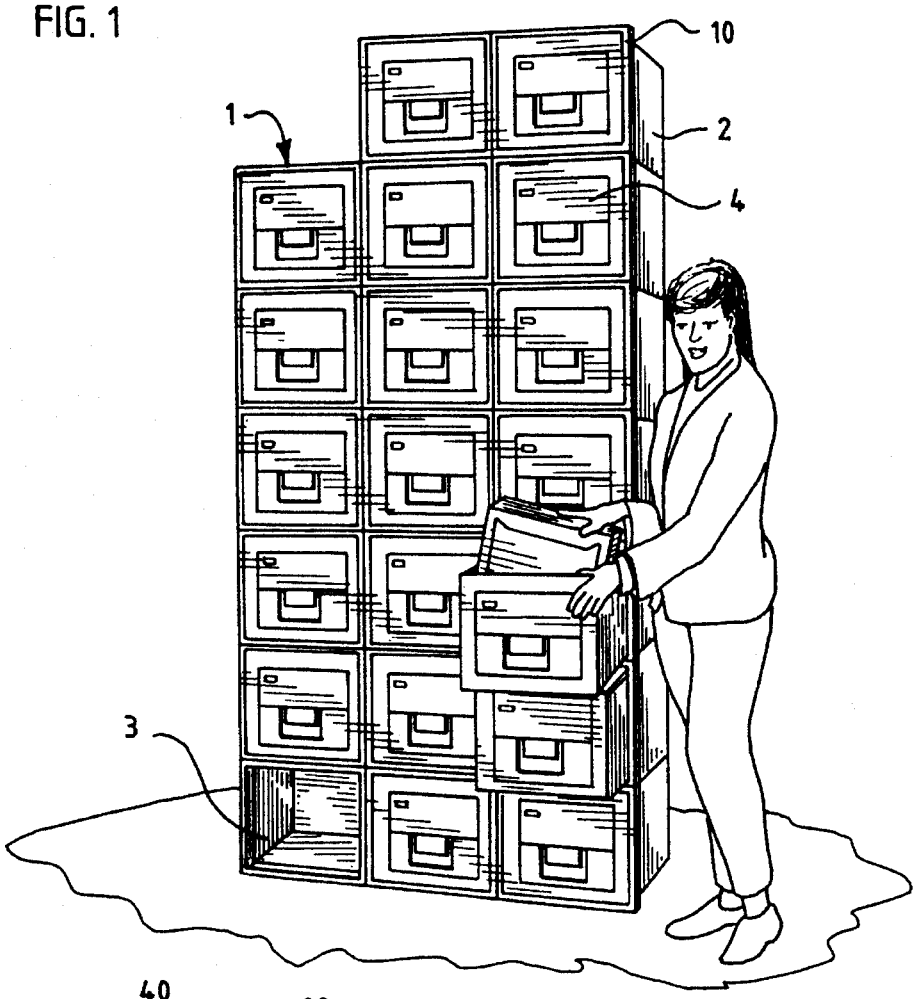
FIG. 1 is a front perspective view of several interlocking frames of the present invention in use where the shells are vertically interlocked and stacked in more than one row.
Figure 2:
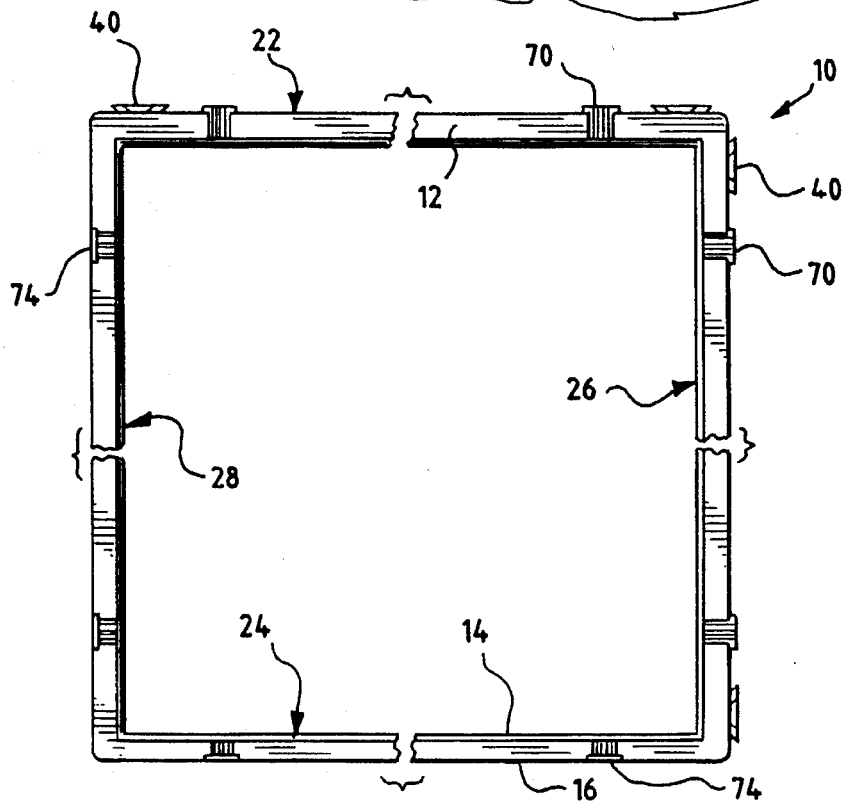
FIG. 2 is a front plan view of one embodiment of the interlocking frame of the present invention.

Referring now to FIG. 1, a plurality of fiberboard containers 1 are shown vertically stacked in rows. A container 1 includes a fiberboard shell 2 having an open front 3 to slidably receive a fiberboard drawer 4. The container 1 preferably has a generally rectilinear shape. In addition, since the containers are generally used to store letter-sized, legal-sized, or check-sized documents, the drawers and shells have dimensions suitable for storing such documents. The container, however, can have any suitable shape and dimension and accordingly, the frame of the present invention is not limited to any particular shape or dimension. For ease of description, however, the container, including the shell and the drawer, as well as the frame will be described as having a parallelogram shape, i.e., the open front of the shell and thus the frame are rectangular or square shaped.

To provide strength to the open front 3 of the shell and to interlock the containers 1 from relative movement from each other, a frame 10 according to the present invention surrounds the perimeter of the open front of the shell. Preferably, the frame 10 is integrally molded from plastic to provide an inexpensive, lightweight, yet durable frame. More preferably, the frame is molded from high impact polystyrene plastic.

The frame 10 has a parallelogram shape to define four sides and an open center through which the drawer 4 slidably extends. The frame 10 has a front face 12 and a rear 18. The front face has a rearward extending outer wall 14 and a rearward extending inner wall 16 with the walls 14 and 16 being spaced apart to define a frame having four substantially U-shaped sides. A channel 20 is also defined by the spaced apart outer wall 14 and inner wall 16 to receive the outer perimeter of the open front 3 of the shell. It will be understood by one skilled in the art that the width of the channel 20 is substantially the same as the thickness of the fiberboard perimeter of the open front of the shell.

Since the frame 10 has a parallelogram shape it can be considered to have four sides: a first side 22, a second side 24 opposite and spaced from the first side, a third side 26 normal to the first and second sides, and a fourth side 28 opposite and spaced from the third side. It will be understood that depending on the shape of the shell (e.g., square) any of the sides may be considered to be the top of the frame. Alternatively, where the shell is shaped as a rectangle either of two sides may be consider the top of the frame. For purposes of description only, unless specifically noted, the first side 22 may be referred to as the top of the frame, the second side 24 may be referred to as the bottom of the frame, the third side 26 may be referred to as the right-hand side of the frame, and the fourth side 28 may be referred to as the left-hand side of the frame.

Preferably, the rear 18 of the frame is provided with at least one retaining member that engages a portion of the shell to secure the frame around the perimeter of the open front of the shell so that the frame is not easily displaced from the shell. The retaining member may be a fang extending into the channel to pierce the wall of the shell or to engage a complementary aperture provided in the shell.

Figure 19:
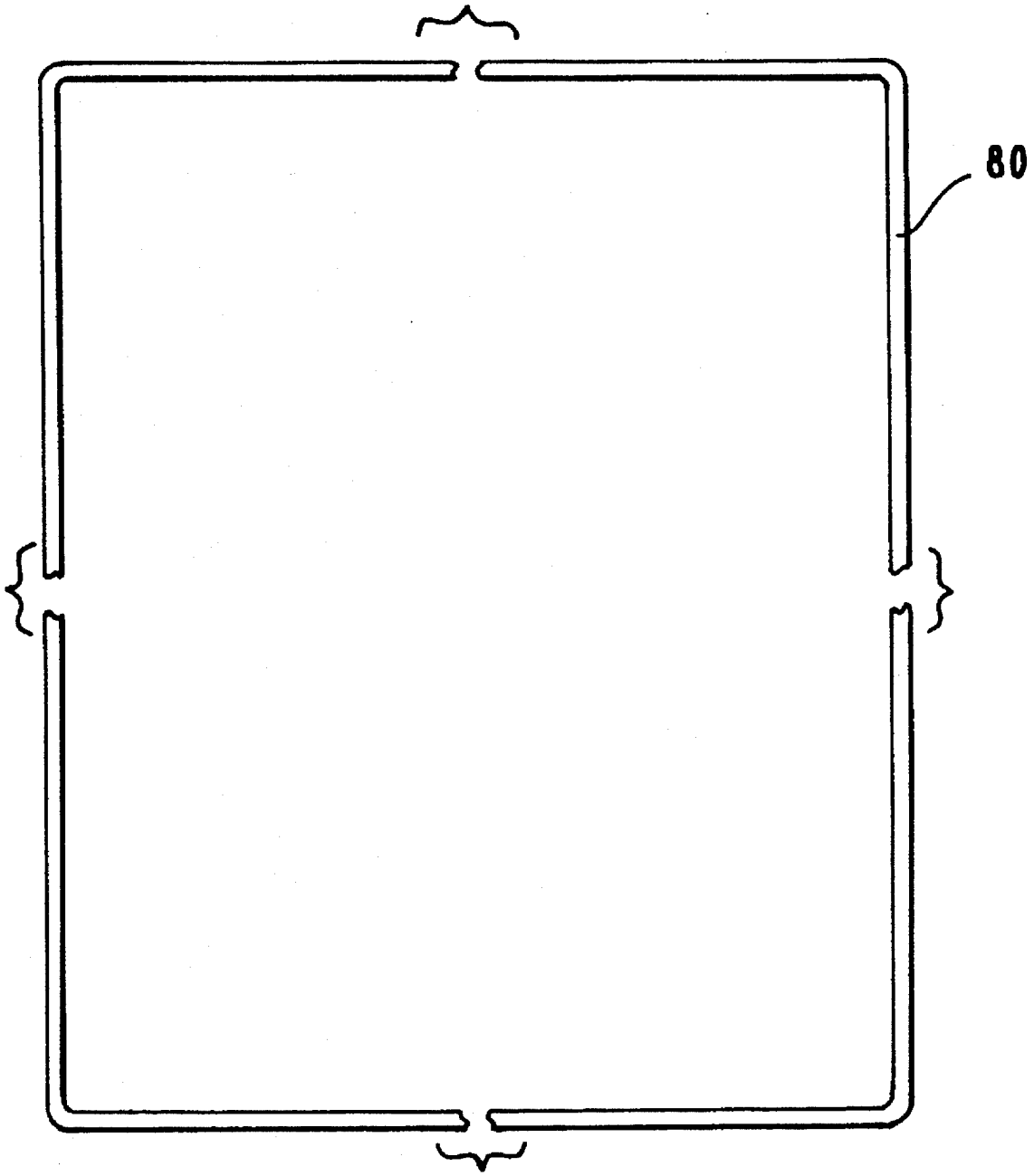
FIG. 19 is a plan view of a metal hoop useful in the frames of the FIGS. 2 and 9.

In addition, at least one reinforcing hoop 80 (FIG. 19) can be provided to contribute additional strength and stability to the frame. The hoop 80 is preferably metal and is secured within and extends around the perimeter of the channel 20.

As noted above, at least one male interlocking member is provided on the outer wall on at least one side of the frame and at least one female interlocking member is provided on the outer wall on the side of the frame opposite the male interlocking member. The female interlocking member is located directly opposite the male interlocking member so that like frames can be secured to each other. The shape of the female interlocking member is complementary with the shape of the male interlocking member and preferably, the female interlocking member slidably receives the male interlocking member. As a result, the male interlocking member of one frame slidably engages the female interlocking member of an adjacent frame to lock the frames from relative movement with respect to each other. Since the male interlocking member protrudes from the outer wall and the female interlocking member is inset within the outer wall, the female interlocking member is preferably provided on the bottom 24 of the frame so that the container will be stable when placed on a storage surface.

To further secure adjacent frames from relative forward and rearward movement with respect to each other, complementary locking members are provided on opposite sides of the frame.

Rows of vertically stacked containers are constructed by first providing shells and drawers. The shells and drawers are typically preformed of fiberboard and are folded by the user to assume the shape as shown in FIG. 1. The shell is generally box-shaped with five of its sides closed and one side open to define a front that slidably receives the drawer. Since the frame 10 is one piece and has substantially the same perimeter dimensions as the perimeter of the open side of the shell, it slidably engages the shell. Accordingly, several shells are formed and like frames are inserted onto the shells. The shells can then be vertically stacked and locked by engaging the female interlocking member of one frame with the male interlocking member of a vertically adjacent frame.

Referring now particularly to FIGS. 2–8, one embodiment of the frame of the present invention is shown. In this embodiment, the top side 22 outer wall is provided with at least one male interlocking member 40 protruding from the outer wall. Preferably, the male member 40 is molded integral with the outer wall. The member 40 may be positioned on the top side 22 at any desirable location according to manufacturing and other considerations. Preferably, two male interlocking members 40 are provided, with one located near the right-hand side 26 of the frame and the other located near the left-hand side 28 of the frame. Each member 40 has a base 41, a front 42, a rear 43, and a top 44 with the top extending beyond the base to define downward tapered side walls 45. As best seen in FIG. 5, the top 44 of the member 40 preferably has a truncated pyramid shape with its base at the rear 18 of the frame. It is to be understood, however, that the top 44 may have any shape as is desirable for manufacturing and other considerations.

Figure 7:
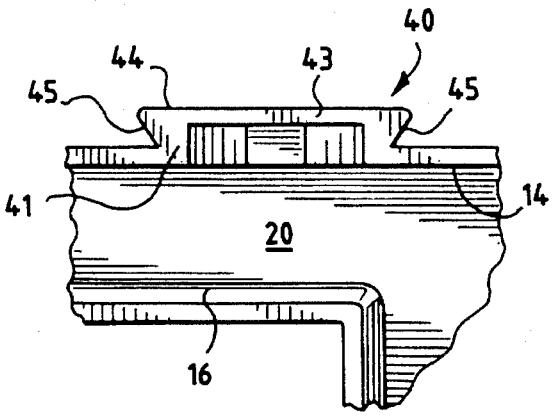
FIG. 7 is an enlarged rear view of one of the male interlocks used in the frame of FIG. 2.
Figure 8:
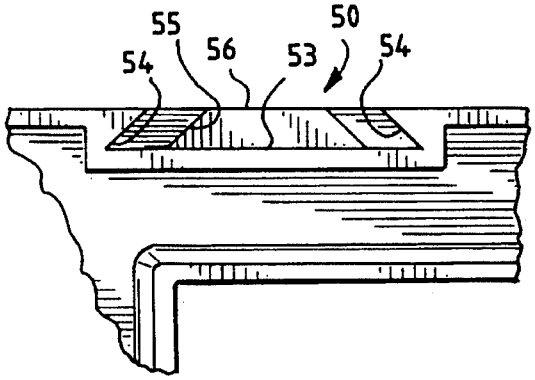
FIG. 8 is an enlarged rear view of one of the female interlocks used in the frame of FIG. 2.
Figure 9:
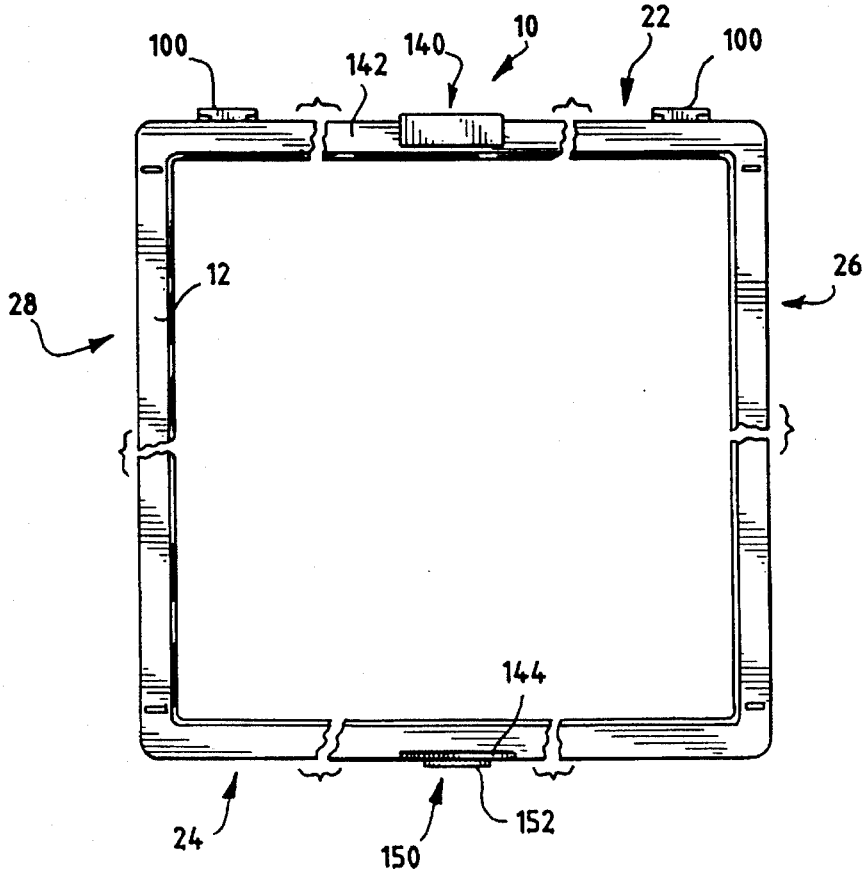
FIG. 9 is a front plan view of another embodiment of the interlocking frame of the present invention.
Figure 10:
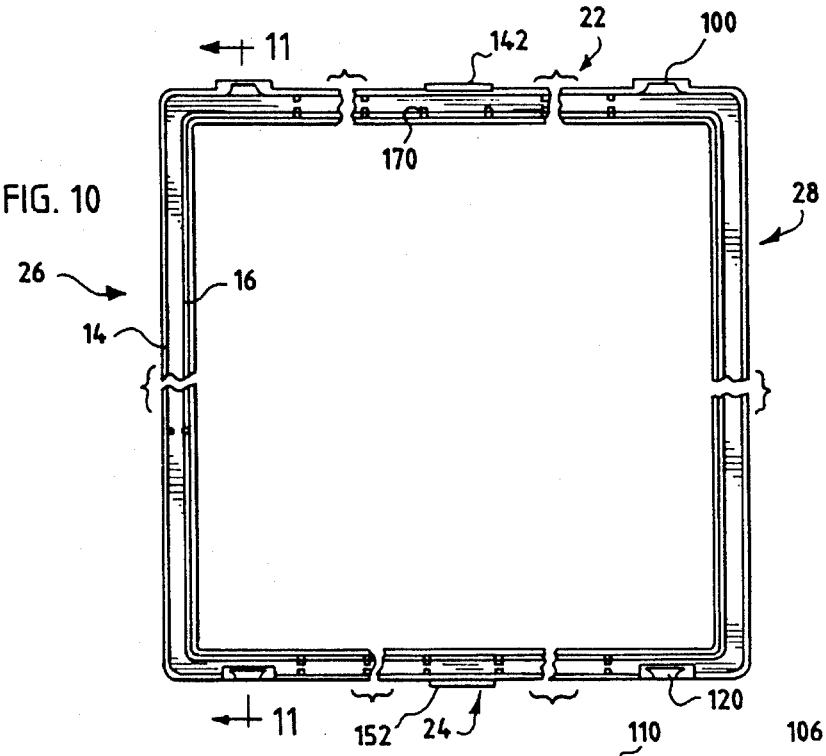
FIG. 10 is a rear plan view of the interlocking frame of FIG. 9.
Figure 11:
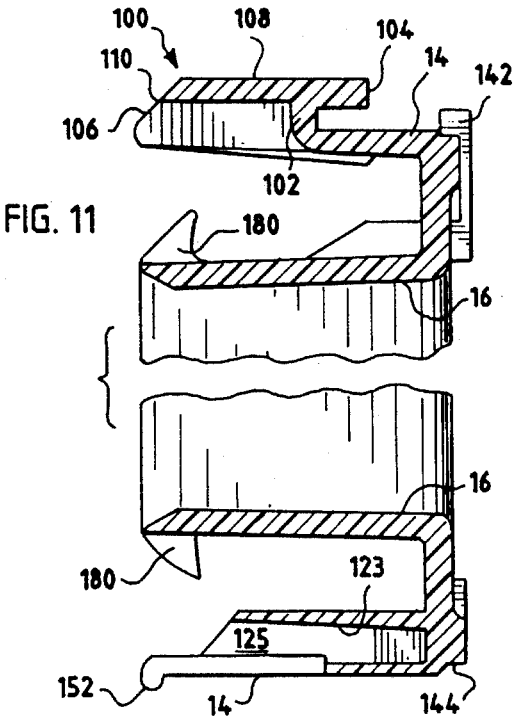
FIG. 11 is a cross sectional view of the interlocking frame of FIG. 10 along line 11—11.
Figure 12:
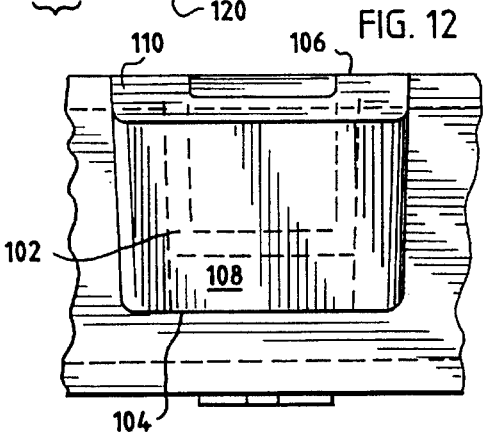
FIG. 12 is a top view of one of the male interlocks used in the frame of FIG. 9 with a portion of the outer wall cut away.
Figure 13:
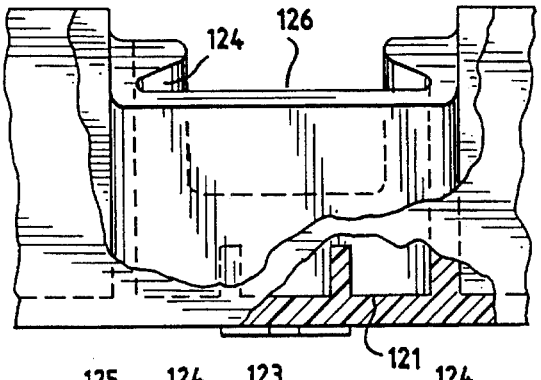
FIG. 13 is a top view of one of the female interlocks used in the frame of FIG. 9.
Figure 14:
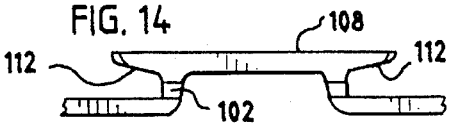
FIG. 14 is an enlarged rear view of one of the male interlocks used in the frame of FIG. 9.
Figure 15:
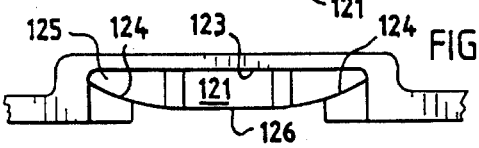
FIG. 15 is an enlarged rear view of one of the female interlocks used in the frame of FIG. 9.

The bottom side 24 outer wall is provided with at least one female interlocking member 50 formed in the outer wall 14 and having a shape complementary with the male member 40 so that it slidably receives and engages a male member 40 on an adjacent frame 10. The female interlocking member 50 is formed within the outer wall 14. As best seen in FIG. 7, the female member 50 also has a truncated pyramid shape with a closed front 51 and an open rear 52 that receives the male interlocking member 40. In addition, the female member has a bottom surface 53 from which tapered walls 54 extend to define a channel 55 and an opening 56. Since the wails 54 are tapered, the width of the opening is smaller than the width of the channel 55 so that when the male interlocking member 40 is engaged with the female interlocking member 50, the male member 40 cannot be vertically removed from the female member 50.

The female interlocking member 50 is located on a side of the frame opposite the male member 40 and is positioned directly opposite the male member 40. In this way, when it is desired to vertically stack the containers, the female members 50 on the frame of one container slidably engage the male members 40 on the frame of the directly below adjacent container. Of course, the number of female interlocking members 50 will be the same as the number of male interlocking members 40. Preferably, two female interlocking members 50 are provided, with one located near the fight-hand side 26 of the frame and the other located near the left-hand side 28 of the frame.

To lock vertically adjacent frames, for example two frames, a bottom and a top frame, the frames are preferably oriented so that the male interlocking member 40 is on the top side 22 of the frame. The top frame will then have the female interlocking members on its bottom side 24. The rear 18 of the top frame is positioned adjacent the front 12 of the bottom frame so that the front 42 of the male member is adjacent the rear 52 of the female member. The top frame is then moved rearward until the front 51 of the female member contacts the front 42 of the male member.

Preferably, in this particular embodiment, at least one male interlocking member 40 is also provided on the outer wall of the right-hand side 26 of the frame and at least one female interlocking member 50 is provided on the outer wall of the left-hand side 28 of the frame directly opposite the male interlocking member. More preferably, two male interlocking members 40 are provided on the outer wall of the right-hand side 26 of the frame, with one located near the top 22 and the other located near the bottom 24. Of course, two female interlocking members 50 will be provided on the left-hand side of the frame directly opposite the male members 40. Alternatively, at least one male interlocking member 40 can be provided on the outer wall of the left-hand side 28 of the frame with at least one female interlocking member 50 provided on the right-hand side 26 of the frame opposite the male member. In this way, columns of vertically stacked containers can be horizontally interlocked in the same fashion as described above for vertically interlocking the containers.

It will be understood by one skilled in the art that although the engagement of the male interlock member 40 with the female interlock member 50 will substantially secure adjacent frames from relative movement with respect to each other, it may be desirable to further secure the frames from forward movement with respect to adjacent frames. Preferably, complementary locking members 70 and 74 are provided on opposite sides of the frame. In particular, locking member 70 includes at least one, preferably two, tabs provided on the outer wall at the juncture of the top side 22 and front face 12 of the frame, preferably on the same side of the frame as a male interlocking member 40. Locking member 74 includes at least one, preferably two cut-outs provided on the outer wall on the side of the frame opposite the locking member 70. In addition, the female locking member 74 is located directly opposite the male locking member 70. The locking member 74 has a flange extending across the width of the cut-out so that the male locking member 70 provided on an adjacent frame can snap into or engage the female locking member 74.

As noted above, the frame may have a retaining member to more fully secure the frame onto the shell. In this embodiment, the retaining member includes at least one flange 60 extending from the outer wall 14 of at least one side of the frame into the channel 20 to bias the wall of the shell toward the inner wall 16. Of course, the flange 60 may extend from the inner wall into the channel 20. Alternatively, the flange 60 may pierce the wall of the shell or engage an aperture provided in the wall of the shell. The flange 60 may also be provided with a cammed surface 62 to simplify the insertion of the frame onto the shell.

In another embodiment of the present invention shown in FIGS. 9–18, wherein like reference numerals refer to like pans, a frame 10 surrounds the perimeter of the open front of the shell. The frame 10 has a front face 12 and a rear 18. The front face has a rearward extending outer wall 14 and a rearward extending inner wall 16 with the walls 14 and 16 being spaced apart to define a frame having four substantially U-shaped sides and a channel 20 to receive the outer perimeter of the open front of the shell. The frame has a first side 22, a second side 24 opposite and spaced from the first side, a third side 26 normal to the first and second sides, and a fourth side 28 opposite and spaced from the third side. As with the embodiment described above, for purposes of description only, the first side 22 may be referred to as the top of the frame, the second side 24 may be referred to as the bottom of the frame, the third side 26 may be referred to as the right-hand side of the frame, and the fourth side 28 may be referred to as the left-hand side of the frame.

In this embodiment, the top side 22 outer wall is provided with at least one male interlocking member 100 protruding from the outer wall. The member 100 may be positioned on the top side 22 at any desirable location according to manufacturing and other considerations. Preferably, two male interlocking members 100 are provided on the top side 22, with one located near the right-hand side 26 of the frame and the other located near the left-hand side 28 of the frame.

The bottom side 24 outer wall is provided with at least one female interlocking member 120 formed in the outer wall and having a shape complementary with the male member 100 so that it slidably receives and engages a male member 100 on a vertically adjacent frame. Preferably, two female interlocking members 120 are provided, with one located near the right-hand side 26 of the frame and the other located near the left-hand side 28 of the frame. Since the female member 120 slidably receives a complementary male member 100, the female member 120 is of course positioned directly opposite the male member 100. In this way when it is desired to vertically stack the containers, like frames may be used so that the female interlocking members 120 of one frame slidably engage the male interlocking members 100 on the directly below adjacent frame.

Referring more particularly to FIGS. 11–16, the male and female interlocking members useful in this embodiment are shown. The male interlocking member 100 is integrally molded with the outer wall 14 on the top side 22 of the frame. The member 100 has a base 102 extending from the outer wall, a front 104, a rear 106, and a top surface 108 including a rear tapered portion 110. The top surface 108 preferably has a rectangular shape although any suitable shape may be used. The top surface 108 extends beyond the base 102 to define tapered side walls 112 that slidably engage a channel defined in the female interlocking member 120.

The female interlocking member 120 is provided in the outer wall 14 of the bottom side 22 of the frame. The female member 120 has a front 121, a rear 122, a bottom surface 123 with tapered walls 124 to define a channel 125, and an opening 126 having a width smaller than the width of the bottom surface.

To lock vertically adjacent frames, for example two frames, a bottom and a top frame, the frames are oriented so that the male interlocking member 100 is on the top side 22 of the frame. The rear 18 of the top frame is positioned adjacent the front 12 of the bottom frame so that the front 104 of the female interlocking member is adjacent the rear 122 of the female member. The top frame is then moved rearward until the front 121 of the female member contacts the front 104 of the male member.

To further lock the frames from relative forward movement with respect to each other, the frames 10 are preferably provided with at least one complementary top and bottom locking members 140 and 150. The top locking member 140 comprises a tab 142 formed on the front face 12 and extending upward beyond the outer wall 14. In this way, as vertically adjacent frames are being engaged, the outer wall on the bottom side 24 of one frame slides over the tab 142 provided on the vertically adjacent frame until the bottom side of one frame substantially abuts the top side of the adjacent frame. It will be appreciated, that because the tab 142 extends beyond the outer wall of the top side 22 it will restrict the forward movement of the frame vertically above it. Preferably, a complementary detent or cut out 144 is provided in the outer wall of the bottom side 24 and front face at their juncture and directly opposite tab 142 to receive the tab.

To further restrict forward relative movement of vertically adjacent frames, the rear of the outer wall on the bottom side 24 of the frame is provided with a depending projection 152. It will be understood that when two frames are engaged, the projection 152 will contact the rear of the outer wall on the top side 22 of the frame vertically below. Preferably, a complementary detent or cut-out 154 is provided in the outer wall at the rear of the top side of the frame and directly opposite the projection 154 to receive the projection.

As noted above and as best seen in FIG. 19, a metal hoop 80 may be provided to contribute additional strength and stability to the frame. The hoop 80 fits within the channel 20 of the frame. Ribs 170 may be provided to more fully secure the hoop 80 within the channel.

The frame 10, as noted above, may have a retaining member to more fully secure the frame onto the shell. The retaining member may include at least one fang 180 formed on the inner or outer wall and extend into the channel 20. The fang 180 may bias the wall of the shell toward the wall of the frame opposite the fang. Alternatively, the fang 180 may pierce the wall of the shell or engage an aperture provided in the wall of the shell.

Of course it should be understood that a wide range of changes and modifications can be made to the embodiments described above. It is therefore intended that the foregoing description illustrates rather than limits this invention, and that it is the following claims, including all equivalents, which define this invention.

What is claimed is:

1. A unitary interlocking frame for use with a container to secure a plurality of file containers, the frame comprising:

a. a front and a rear with the front having a face in the shape of a parallelogram to define four sides, the front face having a rearward extending outer wall spaced from a rearward extending inner wall, the walls defining an open channel at the rear of the frame;

b. at least one male interlocking member formed on and extending from the outer wall of a first side of the frame, the male interlocking member including a base and a top surface, wherein the base extends from the outer wall and the top surface extends from and beyond the base to define downward tapered sides; and, c. at least one female interlocking member set within the outer wall of a third side of the frame opposite the male interlocking member, wherein the female interlocking member is shaped complementary to the male interlocking member to slidably receive the male interlocking member of an adjacent frame to lock the flames from relative movement with respect to each other.

2. The frame of claim 1 wherein two male interlocking members are provided on the first side of the frame and two female interlocking members are provided on the third side of the frame with each female interlocking member located directly opposite the male interlocking members.

3. The frame of claim 1 further having at least one male interlocking member provided on a second side of the frame normal to the first side of the frame and having at least one female interlocking member provided on a fourth side of the frame opposite the male interlocking member provided on the second side.

4. The frame of claim 1 further having a flange extending from at least one of the outer walls or the inner walls into the channel.

5. The frame of claim 1 wherein the male interlocking member has a front adjacent the front of the frame and a rear adjacent the rear of the frame such that the width of the front of the top surface of the male interlocking member is less than the width of the rear of the top surface.

6. The frame of claim 1 further having a metal hoop retained within the channel.

7. The frame of claim 1 further having a locking member formed on at least one side of the frame and spaced from the male and female interlocking members to secure adjacent flames from relative forward movement.

8. The frame of claim 7 wherein the locking member comprises:

a. a tab formed on one side of the front face of the frame and extending beyond the outer wall; and, b. a complementary detent formed on the outer wall adjacent the face of the side of the frame opposite the tab to receive the tab.

9. The frame of claim 8 wherein the locking member further comprises:

a. a depending projection formed on the outer wall adjacent the rear of the side of the frame on which the complementary detent is formed; and, b. a cut-out formed on the outer wall adjacent the rear of the side of the frame on which the tab is formed to receive the depending projection and secure adjacent flames from relative rearward movement.

10. The frame of claim 1 wherein the female interlocking member has a closed front adjacent the front of the frame and an open rear adjacent the rear of the frame.

11. The frame of claim 10 wherein the female interlocking member has a bottom surface and a pair of walls that extend upward from the bottom surface and toward each other, the pair of walls terminating at the outer wall to define an opening and a channel with the opening having a width smaller than the width of the channel.

12. A unitary interlocking frame in the shape of a parellelogram for use with a container shell having an open front, the frame surrounding the open front perimeter of the shell and comprising:

a. a front and a rear with the front having a face with a rearward extending outer wall spaced from a rearward extending inner wall, the walls defining a channel having a width substantially the same as the width of the walls of the shell so that the channel is slidably received by the open front perimeter of the shell;

b. at least one male interlocking member formed on and extending from the outer wall of a first side of the frame, the male interlocking member including a base and a top surface, wherein the base extends from the outer wall and the top surface extends from and beyond the base to define downward tapered sides; and, c. at least one female interlocking member set within the outer wall of a third side of the frame opposite the male interlocking member formed on the first side of the frame, wherein the female interlocking member is shaped complementary to the male interlocking member to slidably receive the male interlocking member of an adjacent frame to lock the frames from relative movement with respect to each other.

13. The frame of claim 12 wherein two male interlocking members are provided on the first side of the frame and two female interlocking members are provided on the third side of the frame with each female interlocking member located directly opposite the male interlocking members.

14. The frame of claim 12 further having at least one male interlocking member provided on a second side of the frame normal to the first side of the frame and having at least one female interlocking member provided on a fourth side of the frame opposite the male interlocking member on the second side.

15. The frame of claim 12 wherein the male interlocking member has a front adjacent the front of the frame and a rear adjacent the rear of the frame such that the width of the front of the top surface of the male interlocking member is less than the width of the rear of the top surface.

16. The frame of claim 12 further having a metal hoop retained within the channel.

17. The frame of claim 12 wherein the female interlocking member has a closed front adjacent the front of the frame and an open rear adjacent the rear of the frame.

18. The frame of claim 17 wherein the female interlocking member has a bottom surface and a pair of walls that extend upward from the bottom surface and toward each other, the pair of walls terminating at the outer wall to define an opening and a channel with the opening having a width smaller than the width of the channel.

19. The frame of claim 12 further having a flange extending from at least one of the outer walls or the inner walls into the channel.

20. The frame of claim 12 further having a locking member comprising:

a. a tab formed on one side of the front face of the frame and extending beyond the outer wall; and, b. a complementary detent formed on the outer wall adjacent the face of the side of the frame opposite the tab to receive the tab.

21. The frame of claim 20 wherein the locking member further comprises:

a. a depending projection formed on the outer wall adjacent the rear of the side of the frame on which the complementary detent is formed; and, b. a cut-out formed on the outer wall adjacent the rear of the side of the frame on which the tab is formed to receive the depending projection and secure adjacent flames from relative rearward movement.

22. In an assembly of file containers positioned adjacent each other with each having a shell with an open front to slidably receive a drawer, a plurality of unitary interlocking frame members to lock adjacent containers from relative movement wherein each frame member comprises:

a. a front and a rear with the from having a face with a rearward extending outer wall spaced from a rearward extending inner wall, the walls defining a channel, the channel having a width substantially the same as the width of the walls of the shell so that the channel is slidably received by the open front perimeter of the shell;

b. at least one male interlocking member formed on and extending from the outer wall of a first side of the frame;

c. at least one female interlocking member set within the outer wall of a third side of the frame opposite the male interlocking member formed on the first side of the frame, wherein the female interlocking member is shaped complementary to the male interlocking member to slidably receive the male interlocking member of an adjacent frame to lock the flames from relative movement with respect to each other.

23. The frame of claim 22 wherein two male interlocking members are provided on the first side of the frame and two female interlocking members are provided on the third side of the frame with each female interlocking member located directly opposite the male interlocking members.

24. The frame of claim 22 further having at least one male interlocking member provided on a second side of the frame normal to the first side of the frame and having at least one female interlocking member provided on a fourth side of the frame opposite the male interlocking member provided on the second side.

25. The frame of claim 22 wherein the male interlocking member has a front adjacent the front of the frame and a rear adjacent the rear of the frame such that the width of the front of the top surface of the male interlocking member is less than the width of the rear of the top surface.

26. The frame of claim 22 further having a metal hoop retained within the channel.

27. The frame of claim 22 wherein the female interlocking member has a closed front adjacent the front of the frame and an open rear adjacent the rear of the frame.

28. The frame of claim 27 wherein the female interlocking member has a bottom surface and a pair of walls that extend upward from the bottom surface and toward each other, the pair of walls terminating at the outer wall to define an opening and a channel with the opening having a width smaller than the width of the channel.

29. The frame of claim 22 further having a flange extending from at least one of the outer walls or the inner walls into the channel.

30. The frame of claim 22 further having a locking member comprising:

a. a tab formed on one side of the front face of the frame and extending beyond the outer wall; and, b. a complementary detent formed on the outer wall adjacent the face of the side of the frame opposite the tab to receive the tab.

31. The frame of claim 30 wherein the locking member further comprises:

a. a depending projection formed on the outer wall adjacent the rear of the side of the frame on which the complementary detent is formed; and, b. a cut-out formed on the outer wall adjacent the rear of the side of the frame on which the tab is formed to receive the depending projection and secure adjacent frames from relative rearward movement.

* * * * *

UNITED STATES PATENT AND TRADEMARK OFFICE

CERTIFICATE OF CORRECTION

PATENT NO. : 5,454,634
DATED : October 3, 1995
INVENTOR(S) : John E. Herbst et al.

It is certified that error appears in the above-indentified patent and that said Letters Patent is hereby corrected as shown below:

Col.8, In claim 1, line 19, delete "flames" and substitute --frames--.

Col. 8, In claim 7, line 4, delete "flames" and substitute --frames--.

Col. 9, In claim 9, line 9, delete "flames" and substitute --frames--.

Col. 10, In claim 14, line 5, after "member" insert --provided--.

Col. 10, In claim 21, line 9, delete "flames" and substitute --frames--.

UNITED STATES PATENT AND TRADEMARK OFFICE

CERTIFICATE OF CORRECTION

PATENT NO. : 5,454,634
DATED : October 3, 1995
INVENTOR(S) : John E. Herbst et al.

It is certified that error appears in the above-indentified patent and that said Letters Patent is hereby corrected as shown below:

Col. 10, In claim 22, line 6, delete "from" and substitute --front--.

Col. 10, In claim 22, line 22, delete "flames" and substitute --frames--.

Signed and Sealed this

Fourth Day of June, 1996

Bruce Lehman

*Attest:*

BRUCE LEHMAN

*Attesting Officer*

*Commissioner of Patents and Trademarks*